US011554411B2

(12) United States Patent
Kato et al.

(10) Patent No.: US 11,554,411 B2
(45) Date of Patent: Jan. 17, 2023

(54) CASTING MOLD MAKING APPARATUS AND MOLD MAKING METHOD

(71) Applicant: Sintokogio, Ltd., Nagoya (JP)

(72) Inventors: Yusuke Kato, Toyokawa (JP); Tomohiro Aoki, Toyokawa (JP)

(73) Assignee: Sintokogio, Ltd., Nagoya (JP)

( * ) Notice: Subject to any disclaimer, the term of this patent is extended or adjusted under 35 U.S.C. 154(b) by 225 days.

(21) Appl. No.: 16/607,455

(22) PCT Filed: Mar. 5, 2018

(86) PCT No.: PCT/JP2018/008431
§ 371 (c)(1),
(2) Date: Oct. 23, 2019

(87) PCT Pub. No.: WO2018/211785
PCT Pub. Date: Nov. 22, 2018

(65) Prior Publication Data

US 2021/0276076 A1 Sep. 9, 2021

(30) Foreign Application Priority Data

May 19, 2017 (JP) ..... JP2017-100267

(51) Int. Cl.
*B22C 15/08* (2006.01)
*B22C 5/04* (2006.01)
(Continued)

(52) U.S. Cl.
CPC ..... *B22C 5/044* (2013.01); *B22C 5/12* (2013.01); *B22C 9/02* (2013.01); *B22C 15/08* (2013.01); *B22C 15/245* (2013.01)

(58) Field of Classification Search
CPC ..... B22C 5/04; B22C 5/0409; B22C 5/044; B22C 5/12; B22C 15/23; B22C 15/24; B22C 15/245
See application file for complete search history.

(56) References Cited

U.S. PATENT DOCUMENTS 4,460,032 A 7/1984 Lund
2007/0196529 A1 8/2007 Zenpo et al.
(Continued)

FOREIGN PATENT DOCUMENTS

CN 104028151 A 9/2014
CN 204865801 U 12/2015
(Continued)

OTHER PUBLICATIONS

Second Notice of Examination Opinion, State Intellectual Property Office of People's Republic of China, Chinese Application No. 201880004514.0, dated May 8, 2021, 6 pages.
(Continued)

*Primary Examiner* — Kevin E Yoon
(74) *Attorney, Agent, or Firm* — Taft Stettinius & Hollister LLP

(57) ABSTRACT

A casting mold making apparatus and a method employing a tank with a pour hole formed at a bottom wall of the tank and an opening section open toward the opposite side to a bottom wall side. A first process of the method includes stirring component materials inside the tank with a stirring impeller so as to make a foam mixture while an opening section side of the tank is closed and the pour hole is closed. The second process is performed after the first process and includes opening the pour hole, pressing the tank against a mold such that a fill hole formed so as to pass into the mold is disposed adjacent to the pour hole, and supplying compressed air into the tank while stirring the foam mixture inside the tank with the stirring impeller so as to fill the foam mixture into a cavity of the mold.

8 Claims, 9 Drawing Sheets

(51) Int. Cl.

| | |
|---|---|
| ***B22C 5/12*** | (2006.01) |
| ***B22C 9/02*** | (2006.01) |
| ***B22C 15/24*** | (2006.01) |

(56) References Cited

U.S. PATENT DOCUMENTS

| | | | | |
|---|---|---|---|---|
| 2007/0209774 | A1 | 9/2007 | Hori et al. | |
| 2009/0092171 | A1 | 4/2009 | Kato et al. | |
| 2016/0052047 | A1* | 2/2016 | Uchida | B22C 15/02 164/37 |
| 2018/0326473 | A1* | 11/2018 | Maegawa | B22C 1/12 |

FOREIGN PATENT DOCUMENTS

| | | | |
|---|---|---|---|
| GB | 2046152 | A | 11/1980 |
| JP | S551961 | A | 1/1980 |
| JP | S5594756 | A | 7/1980 |
| JP | 4425385 | B2 | 3/2010 |
| WO | 2005089984 | A1 | 9/2005 |
| WO | 2006134841 | A1 | 12/2006 |
| WO | 2007066509 | A1 | 6/2007 |

OTHER PUBLICATIONS

International Search Report, Japan Patent Office, International Application No. PCT/JP2018/008431, dated Apr. 17, 2018, 3 pages.

Written Opinion of the International Searching Authority, Japan Patent Office, International Application No. PCT/JP2018/008431, dated Apr. 17, 2018, 4 pages.

Extended European Search Report, European Patent Office, European Application No. 18802615.7, dated Aug. 21, 2020, 11 pages.

Chinese Third Office Action; The State Intellectual Property Office of People's Republic of China; Chinese Application No. 201880004514.0; dated Nov. 1, 2021; 7 pages.

* cited by examiner

CASTING MOLD MAKING APPARATUS AND MOLD MAKING METHOD

CROSS-REFERENCE TO RELATED APPLICATIONS

This application is a U.S. National Phase Application of International PCT Application No. PCT/JP2018/008431 filed Mar. 5, 2018, which claims the benefit of, and priority to, Japanese Patent Application Serial No. 2017-100267, which was filed on May 19, 2017, the contents of each application are incorporated herein by reference in their entirety.

TECHNICAL FIELD

A preferable embodiment relates to a casting mold making apparatus and a casting mold making method.

BACKGROUND ART

As a casting mold making apparatus, a known apparatus includes a mixture storage unit combining a stirring tank feature to stir component materials of a mix together to make a foam mixture, and an injection tank feature to inject the foam mixture into a mold (for example, Japanese Patent No. 4428385). In such an apparatus, an injection piston is retracted from the mixture storage unit when mixing the component materials in the mixture storage unit, and a stirring impeller for mixing is retracted from the mixture storage unit during filling when the mixture is being pressed within the mixture storage unit and is filled into the mold.

SUMMARY OF INVENTION

Technical Problem

However, in the configuration described above, there is a concern that foam mixture, which is adhered to the piston or the stirring impeller, might splash from the piston or the stirring impeller, the piston being retracted during mixing and the stirring impeller being retracted during filling.

In consideration of the above circumstances, the present disclosure obtains a casting mold making apparatus and a casting mold making method capable of preventing or effectively suppressing the foam mixture from splashing during mixing and during filling.

Solution to Problem

An apparatus for making a casting mold of a first aspect of the present disclosure includes a tank, a lid member, a pour-hole closure mechanism, a stirring mechanism, a mold, and a compressed air supply system. Component materials for making a foam mixture are fed into the tank which is formed with the pour hole that passes through a bottom wall of the tank and an opening section that opens toward an opposite side from a bottom wall side. The lid member opens and closes an opening section side of the tank. The pour-hole closure mechanism opens and closes the pour hole of the tank. The stirring mechanism stirs component materials inside the tank with a stirring impeller and makes a foam mixture in a state in which the opening section side is closed by the lid member. The mold is formed with a fill hole that passes into the mold and the fill hole is adjacent to the pour hole of the tank. The compressed air supply system supplies compressed air into the tank in a case in which the foam mixture inside the tank is filled into a cavity of the mold from the pour hole via the fill hole, with the pour hole in an opened state.

According to the above configuration, the component materials for making the foam mixture are fed into the tank and the component materials inside the tank are stirred with the stirring impeller of the stirring mechanism in the state in which the opening section side of the tank is closed by the lid member, thereby making the foam mixture. The pour hole of the tank is opened and closed by the pour-hole closure mechanism, and the fill hole is formed passing into the mold and is adjacent to the pour hole of the tank. The compressed air supply system, in an open state of the pour hole, supplies compressed air into the tank in a case in which the foam mixture inside the tank is filled into the cavity of the mold from the pour hole via the fill hole.

There is no need to retract a portion of the mechanism to fill the foam mixture into the mold from inside the tank to outside the tank when making the foam mixture in the tank, and there is also no need to retract a portion of the stirring impeller from inside the tank to outside the tank when the foam mixture is filled from the tank into the mold. The foam mixture does not splash outside the tank.

An apparatus for making a casting mold of a second aspect of the present disclosure is the configuration of the first aspect, further includes a hole-opening closure section, a movement mechanism and an open-close controller. The hole-opening closure section is provided at the stirring impeller and is capable of closing the pour hole. The movement mechanism moves the hole-opening closure section between an open position at which the pour hole is open and a closed position at which the pour hole is closed. The open-close controller controls the movement mechanism so as to move the hole-opening closure section to the closed position after the compressed air supply system has supplied compressed air into the tank and the foam mixture inside the tank has been filled into the cavity of the mold from the pour hole via the fill hole.

According to the configuration described above, the movement mechanism moves the hole-opening closure section, which is provided at the stirring impeller, between the open position at which the pour hole is open and the closed position at which the pour hole is closed. The open-close controller controls the movement mechanism so as to move the hole-opening closure section to the closed position after the compressed air supply system has supplied compressed air into the tank and the foam mixture inside the tank has been filled into the cavity of the mold from the pour hole via the fill hole. This enables backflow of the foam mixture from the cavity of the mold into the tank to be prevented.

An apparatus for making a casting mold of a third aspect of the present disclosure is the configuration of the first aspect or the second aspect, further includes a component material feeder, a lift mechanism, and a lift controller. The component material feeder, which introduces component materials into the tank, is formed at a sidewall at the opening section side of the tank. The lift mechanism raises and lowers the lid member between a first position and a second position. The first position is positioned further toward the opening section side from a flow path lower end of the component material feeder, and the second position is positioned further toward the bottom wall side from the flow path lower end of the component material feeder. The lift controller controls the lift mechanism such that the lid member is disposed at the first position in a case in which the component materials are fed into the tank from the component material feeder, and such that the lid member is disposed at the second position in a case in which the foam mixture inside the tank is filled into the cavity of the mold from the pour hole via the fill hole.

According to the configuration described above, the component material feeder, which introduces component materials into the tank, is formed at a sidewall at the opening section side of the tank. The lift mechanism raises and lowers the lid member between the first position, which is positioned further toward the opening section side from the flow path lower end of the component material feeder, and the second position, which is positioned further toward the bottom wall side from the flow path lower end of the component material feeder. The lift controller controls the lift mechanism such that the lid member is disposed at the first position in a case in which the component materials are fed into the tank from the component material feeder. This enables the component material feeder to be used to feed the component materials into the tank. The lift controller also controls the lift mechanism such that the lid member is disposed at the second position in a case in which the foam mixture inside the tank is filled into the cavity of the mold from the pour hole via the fill hole. This enables the compressed air supplied into the tank from the compressed air supply system to be suppressed from leaking from the component material feeder when filling the foam mixture.

A method for making a casting mold of a fourth aspect of the present disclosure is a method for making a casting mold by filling a foam mixture into a cavity of a mold. The method includes a first process and a second process. The first process includes feeding component materials for making a foam mixture into a tank, the tank being formed with a pour hole that passes through a bottom wall of the tank and an opening section that opens toward an opposite side to a bottom wall side. The first process also includes stirring the component materials inside the tank with a stirring impeller so as to make a foam mixture in a state in which an opening section side of the tank is closed by the lid member and the pour hole is closed by a pour-hole closure mechanism. The second process is performed after the first process and includes actuating the pour-hole closure mechanism to open the pour hole, pressing the tank against the mold such that the pour hole is disposed adjacent to a fill hole that is formed so as to pass into the mold, and supplying compressed air into the tank while stirring the foam mixture inside the tank with the stirring impeller so as to fill the foam mixture inside the tank into a cavity of the mold from the pour hole via the fill hole.

According to the configuration described above, in the first process the component materials for making the foam mixture are fed into the tank, and the component materials inside the tank are stirred with the stirring impeller so as to make a foam mixture in a state in which the opening section side of the tank is closed by the lid member and the pour hole of the tank is closed by the pour-hole closure mechanism. In the second process, performed after the first process, the pour-hole closure mechanism is actuated to open the pour hole, the tank is pressed against the mold such that the pour hole is disposed adjacent to the fill hole formed so as to pass into the mold, and compressed air is supplied into the tank while stirring the foam mixture inside the tank with the stirring impeller so as to fill the foam mixture inside the tank into the cavity of the mold from the pour hole via the fill hole.

There is no need to retract a portion of the mechanism to fill the foam mixture into the mold from inside the tank to outside the tank when making the foam mixture in the tank, and there is also no need to retract a portion of the stirring impeller from inside the tank to outside the tank when the foam mixture is filled from the tank into the mold. The foam mixture does not splash outside the tank.

A method for making a casting mold of a fifth aspect of the present disclosure is the configuration of the fourth aspect, wherein an actuation speed of the stirring impeller during stirring in the second process is a lower speed than an actuation speed of the stirring impeller during stirring in the first process.

According to the configuration described above, due to the actuation speed of the stirring impeller during stirring in the second process being a lower speed than the actuation speed of the stirring impeller during stirring in the first process, the foam mixture can be stably filled into the cavity of the mold while the behavior of the foam mixture inside the tank is stabilized in the second process.

A method for making a casting mold of a sixth aspect of the present disclosure is the configuration of the fourth aspect or fifth aspect, wherein after stirring the component materials inside the tank with a stirring impeller and making the foam mixture in the first process, the stirring impeller is moved to separate from the bottom wall prior to filling the foam mixture inside the tank into the cavity of the mold from the pour hole via the fill hole in the second process.

According to the configuration described above, due to the stirring impeller being moved to separate from the bottom wall prior to filling the foam mixture inside the tank into the cavity of the mold, the foam mixture can be prevented or suppressed from being impeded from passing through the pour hole as it would be by the stirring impeller being disposed at a location on the bottom wall side when the foam mixture is filled into the cavity of the mold.

A method for making casting mold of a seventh aspect of the present disclosure is the configuration of any one of the fourth to the sixth aspects, wherein, in a case in which the foam mixture inside the tank is filled into the cavity of the mold in the second process, a pressure of compressed air supplied into the tank within a period from starting filling the foam mixture to immediately before filling completion is lower than a pressure of compressed air supplied into the tank at completion of filling the foam mixture and directly after filling completion.

According to the configuration described above, the pressure of compressed air supplied into the tank within a period from starting filling the foam mixture to immediately before filling completion is lower than the pressure of compressed air supplied into the tank at completion of filling the foam mixture and directly after filling completion. The compressed air can accordingly be prevented or suppressed from breaking through the foam mixture during foam mixture filling, and the foam mixture can be suppressed from flowing back after completion of filling the foam mixture.

A method for making a casting mold of an eighth aspect of the present disclosure is the configuration of any one of the fourth to the seventh aspects, wherein after the foam mixture inside the tank has been filled into the cavity of the mold from the pour hole via the fill hole in the second process, the stirring impeller is moved to a position in which a portion of the stirring impeller closes the pour hole.

According to the configuration described above, due to a portion of the stirring impeller closing the pour hole after the foam mixture has been filled into the cavity of the mold, backflow of the foam mixture from the cavity of the mold into the tank can be prevented.

Advantageous Effects

As described above, a preferable embodiment exhibits the advantageous effect of being able to prevent or effectively suppress splashing of the foam mixture during mixing and during filling.

DESCRIPTION OF EMBODIMENTS

Figure 1:
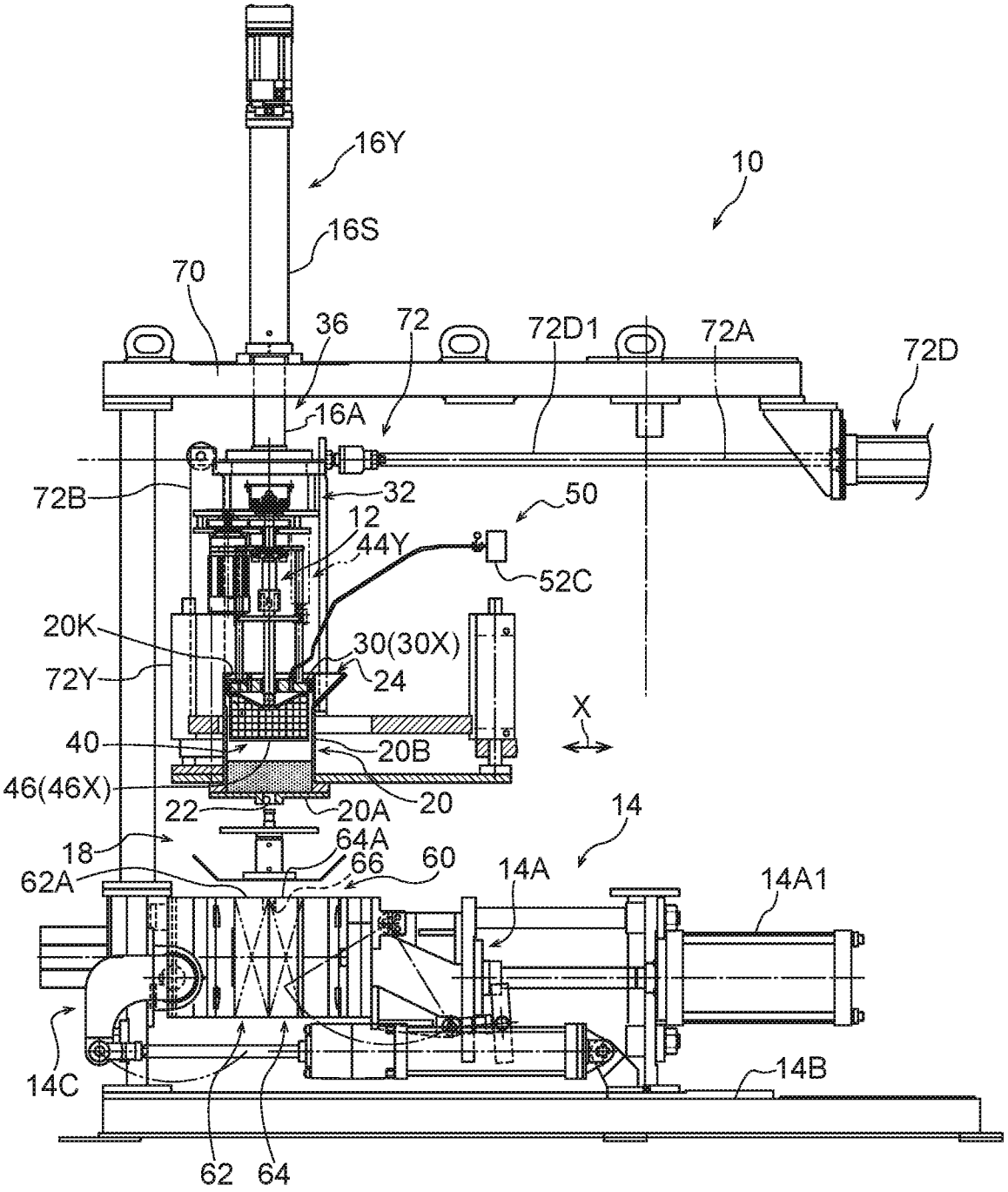
FIG. 1 is a schematic front view of a casting mold making apparatus according to an exemplary embodiment of the present invention, illustrating a state during molding.
Figure 2:
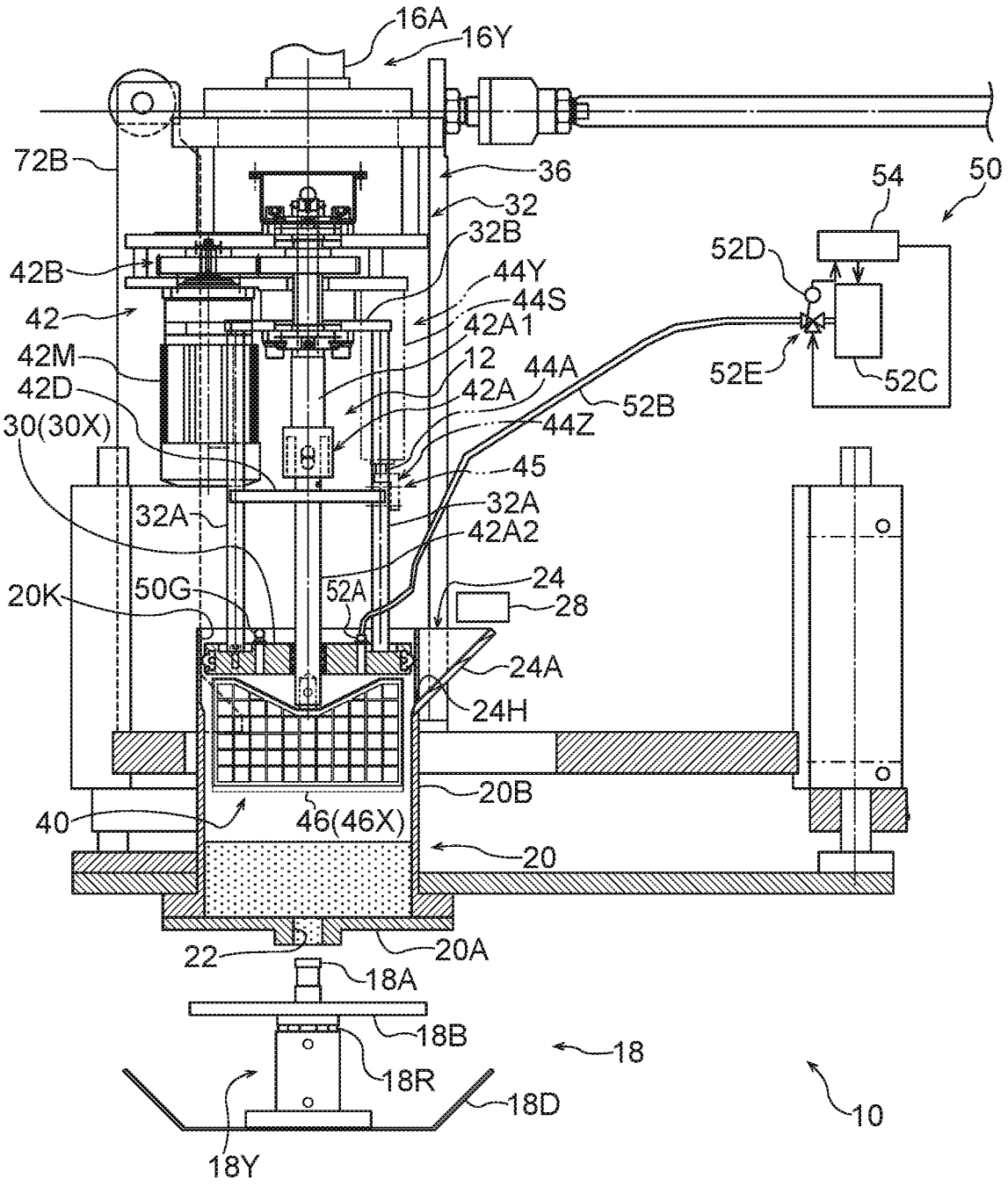
FIG. 2 is an enlarged partial view illustrating part of the casting mold making apparatus of FIG. 1.
Figure 3:
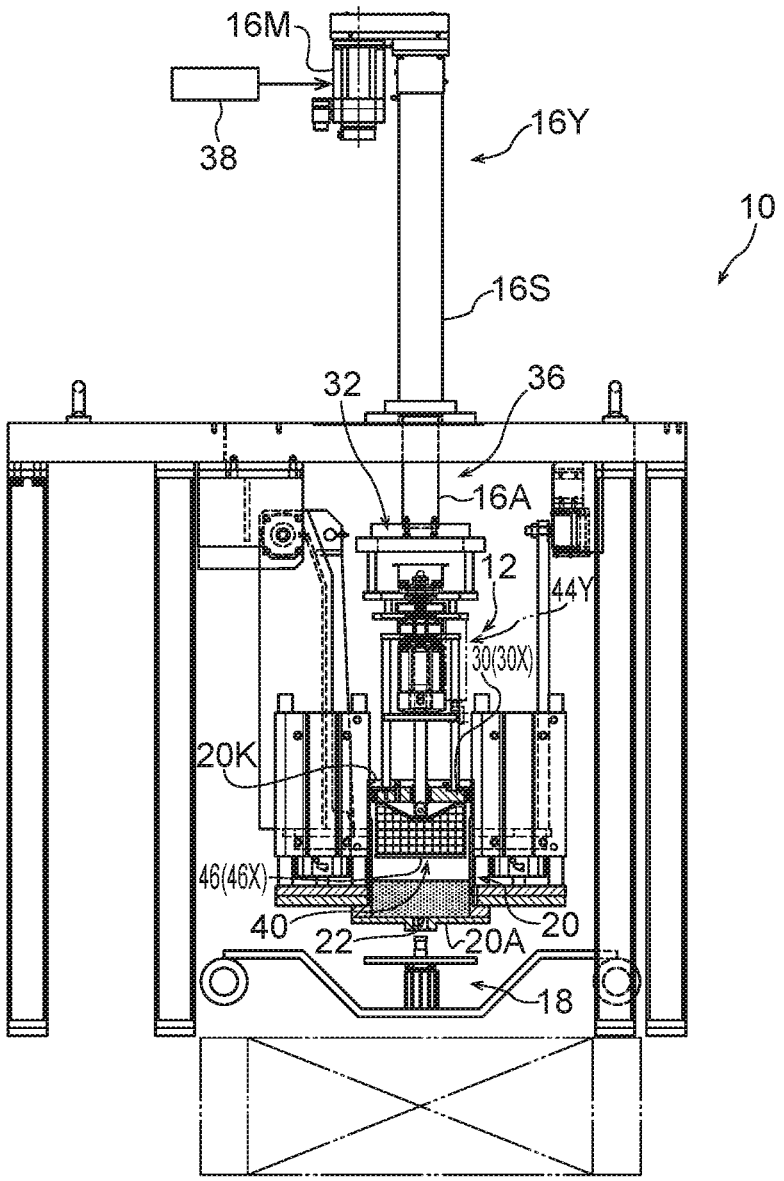
FIG. 3 is a left side view illustrating the casting mold making apparatus of FIG. 1, as viewed from the left side face.
Figure 4:
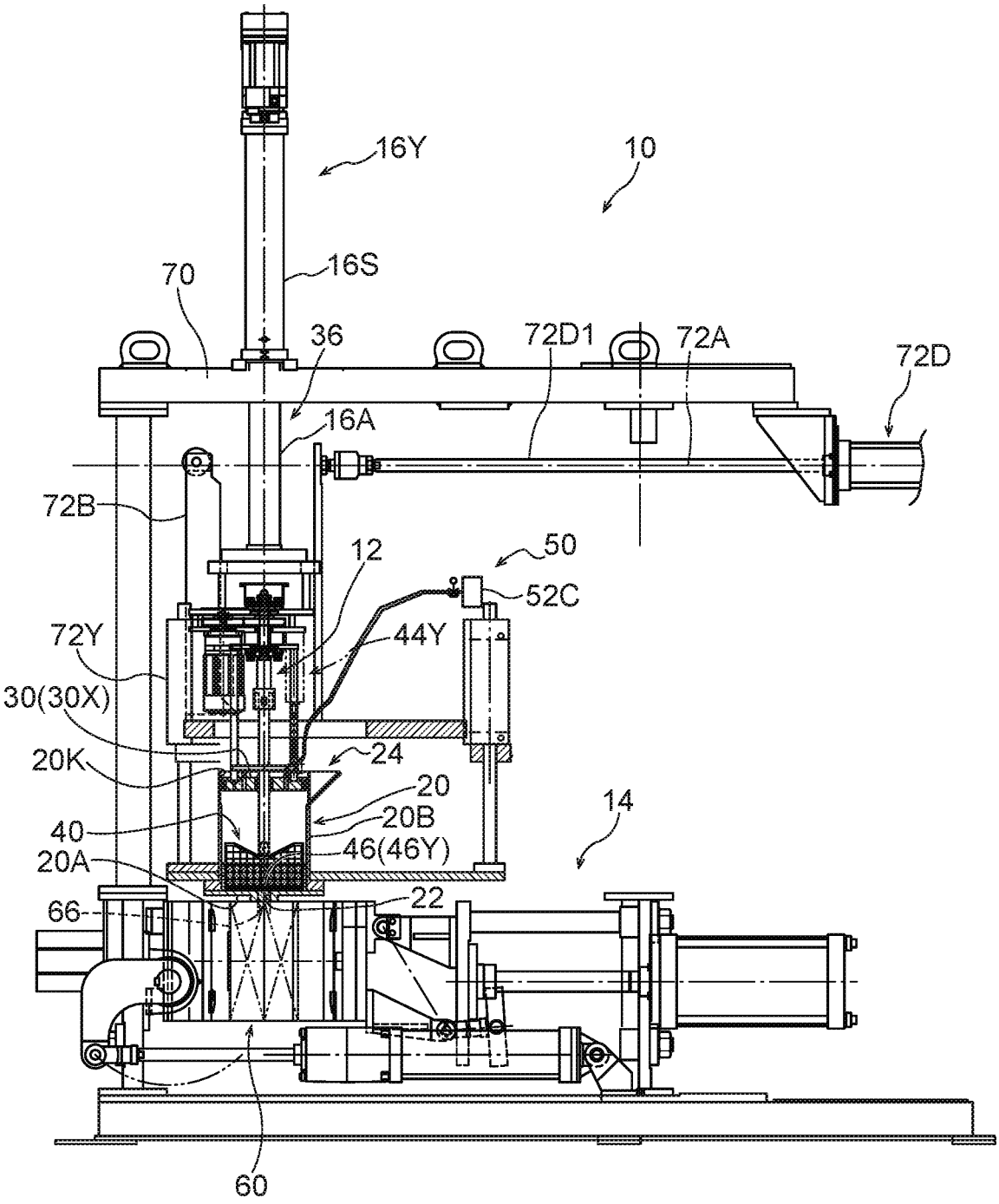
FIG. 4 is a schematic front view of the casting mold making apparatus of FIG. 1, and illustrating an example of a state immediately after foam mixture filling.
Figure 5:
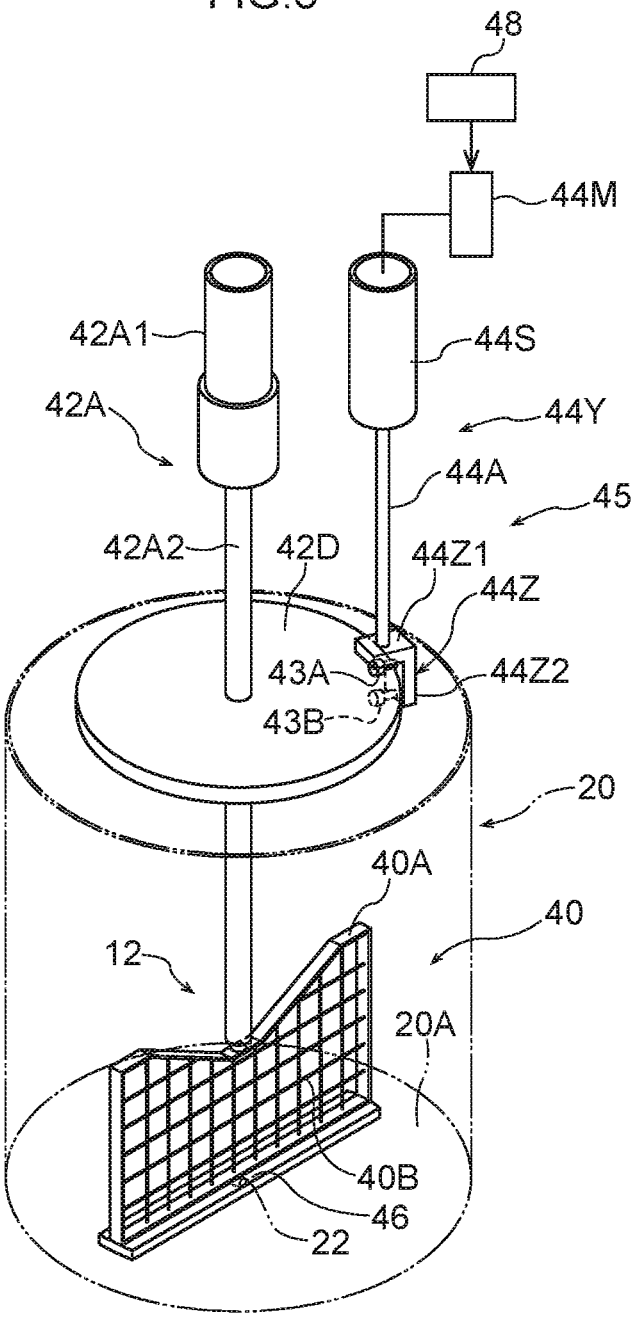
FIG. 5 is a schematic perspective view illustrating part of a stirring mechanism of FIG. 1.
Figure 6:
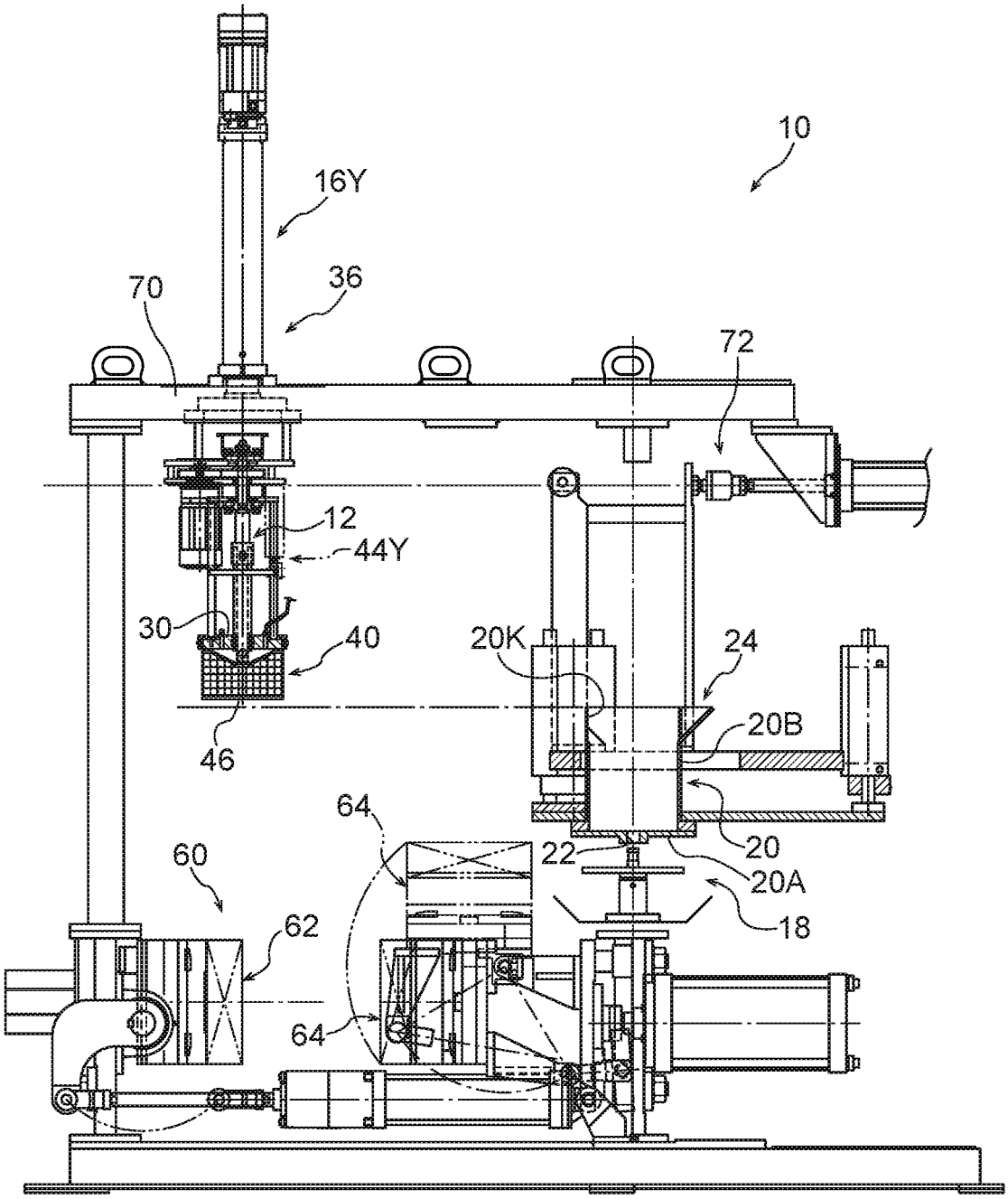
FIG. 6 is a schematic front view of the casting mold making apparatus of FIG. 1, and illustrating an example of a state during cleaning and during maintenance.

Description follows regarding a casting mold making apparatus according to an exemplary embodiment of the present invention, with reference to FIG. 1 to FIG. 9. Note that hatching has been omitted as appropriate from smaller portions in the drawings in order to make the drawings more legible. FIG. 1 is a schematic front view of a casting mold making apparatus 10 according to the present exemplary embodiment (with a front view cross-section of part thereof). FIG. 2 is an enlarged partial view illustrating part of the casting mold making apparatus 10 of FIG. 1. FIG. 3 is a left side view illustrating the casting mold making apparatus 10. FIG. 4 is a schematic front view of the casting mold making apparatus 10, and illustrates an example of a state immediately after foam mixture filling. FIG. 6 is a schematic front view of the casting mold making apparatus 10, and illustrates a state during cleaning and during maintenance.

Overall Configuration of Casting Mold Making Apparatus

First an outline description will be given regarding the overall configuration of the casting mold making apparatus 10. Note that the casting mold making apparatus 10 includes a non-illustrated control board. The control board is configured including an operation section, and a storage section storing a program to control processing of the casting mold making apparatus 10. The casting mold making apparatus 10 operates by a program being executed in response to operation at the operation section by an operator.

As illustrated in FIG. 2, the casting mold making apparatus 10 includes a tank 20 and a lid member 30. The tank 20 is formed with a bottomed cylindrical shape (or more widely defined as a container shape) including a bottom wall 20A, with an opening section 20K formed open toward the opposite side to a bottom wall 20A side of the tank 20. Component materials for making the foam mixture (sand (or more widely, particulate aggregate), water soluble binder, water, and additives (for example, foaming agent)) are fed into the tank 20, and the tank is capable of storing these component materials. Note that component materials in the tank 20 and the foam mixture are simplified and illustrated by dots in FIG. 1 to FIG. 4, and in FIG. 7A to FIG. 9C.

A pour hole 22 is formed so as to pass through the bottom wall 20A of the tank 20. As an example in the present exemplary embodiment, a single pour hole 22 is provided in the tank 20 (see FIG. 5), and is opened or closed by a plug mechanism 18. A component material feeder 24 is formed at an opening section 20K side of a sidewall 20B of the tank 20 for introducing the component materials into the tank 20. The component material feeder 24 includes a hole 24H formed so as to pass through the sidewall 20B, and a chute 24A having an inclined shape for guiding the component materials into the hole 24H. A component material feed device 28 (illustrated as a block) is provided above the chute 24A. The component material feed device 28 includes, although omitted in the drawings, a feed mechanism for each of the component materials. The lid member 30 is disposed at an opening section 20K side of the tank 20 so as close the opening section 20K in a tightly closed state. A seal member (packing) is provided around an outer peripheral portion of the lid member 30 at which contact is made with the opening section 20K side of the tank 20, so as to achieve a hermetically sealed state of the interior of the tank 20.

The casting mold making apparatus 10 includes a stirring mechanism 12. The stirring mechanism 12 includes a stirring impeller 40 at a bottom section of the stirring mechanism 12. The component materials inside the tank 20 are stirred by the stirring impeller 40 in a state in which the opening section 20K side is closed by the lid member 30, so as to make the foam mixture.

As illustrated in FIG. 1 and FIG. 4, the casting mold making apparatus 10 also includes a molding mechanism 14 at a lower side of the apparatus. The molding mechanism 14 includes a mold 60 for molding the foam mixture that has been kneaded by the stirring mechanism 12 into a predetermined shape to make a casting mold. As illustrated in FIG.

4, a fill hole 66 is formed passing into the mold 60 so as to be adjacent to the pour hole 22 in the tank 20.

The casting mold making apparatus 10 includes a compressed air supply system 50. In order to fill the foam mixture that is inside the tank 20 into a cavity of the mold 60 (a space for making the casting mold) from the pour hole 22 via the fill hole 66, the compressed air supply system 50 supplies compressed air into the tank 20 with the pour hole 22 in an open state. The casting mold making apparatus 10 also includes a casting mold extracting mechanism (not illustrated in the drawings) for taking, in coordination with the molding mechanism 14, the casting mold out from the mold 60 by opening the mold 60.

Furthermore, as illustrated in FIG. 1, the casting mold making apparatus 10 includes a first movement mechanism 72 to move the tank 20 (in the arrow X direction) along a machine upper frame 70 extending along an apparatus left-right direction. The first movement mechanism 72 is a mechanism for moving the tank 20 between a first position (the position illustrated in FIG. 1) where the tank 20 is disposed during mold making, and a second position (the position illustrated in FIG. 6) where the tank 20 is retracted to an apparatus right side from the first position.

Each Mechanism

Each of the mechanisms will now be described.

The first movement mechanism 72 for moving the tank 20 as illustrated in FIG. 1 along the apparatus left-right direction includes a non-illustrated guide section extending along the apparatus left-right direction at the machine upper frame 70, as well as a traveling trolley 72B capable of traveling along the guide section. A known guide rail structure may, for example, be applied as the guide section to guide the traveling trolley 72B, and so the guide section is omitted from illustration in FIG. 1 and the like. The range of travel of the traveling trolley 72B is a range encompassing above the mold 60. The tank 20 is attached to the traveling trolley 72B through a cylinder 72Y employed for vertical movement. In other words, the tank 20 is supported by being vertically suspended from the traveling trolley 72B using the cylinder 72Y. As illustrated in FIG. 4, the tank 20 is movable vertically to a position pressed against the mold 60 by actuation of the cylinder 72Y.

Moreover, one end of a rod 72D1 extending in the apparatus left-right direction is fixed to an upper end portion of the traveling trolley 72B. The rod 72D1 configures a portion of the cylinder 72D that is fixed to a location at an apparatus right side of the machine upper frame 70, and is capable of extending or retracting along the apparatus left-right direction by actuation of the cylinder 72D. Namely, the first movement mechanism 72 is configured to move the tank 20 along the apparatus left-right direction by causing the traveling trolley 72B to travel (move) along the guide section (not illustrated in the drawings). The single-dot broken line 72A in the drawings indicates the axial center of the rod 72D1.

As illustrated in FIG. 2, the stirring mechanism 12 includes a stirring impeller actuation mechanism 42 to actuate the stirring impeller 40. The stirring impeller actuation mechanism 42 includes a rotation shaft 42A for rotating the stirring impeller 40. The rotation shaft 42A extends along an apparatus vertical direction (the same direction as a depth direction of the tank 20) and passes through a central portion of the lid member 30. The stirring impeller 40 is fixed to a lower end portion of the rotation shaft 42A, which is disposed so as to be rotatable about its own axis. The rotation shaft 42A is configured so that an upper end portion side thereof is connected through a drive force transmission section 42B to an output shaft of a motor 42M. Namely, in the stirring mechanism 12, the stirring impeller 40 vertical suspended from the rotation shaft 42A is rotated by actuation of the motor 42M, so as to stir (knead) the content of the tank 20.

As illustrated in FIG. 2, the rotation shaft 42A is a telescopic structure axially supported by a horizontally disposed intermediate plate 32B, and includes a rotation shaft outer cylinder 42A1 and a rotation shaft inner cylinder 42A2. The rotation shaft outer cylinder 42A1 and the rotation shaft inner cylinder 42A2 extend in the apparatus vertical direction. The rotation shaft inner cylinder 42A2 extends out to a lower side from the center of the rotation shaft outer cylinder 42A1. The stirring impeller 40 is fixed to a lower end portion of the rotation shaft inner cylinder 42A2.

As illustrated in FIG. 5, a flange shaped guide disk 42D is fixed in advance to a length direction intermediate portion of the rotation shaft inner cylinder 42A2. The guide disk 42D is provided coaxially to the rotation shaft inner cylinder 42A2, and is disposed so as to extend toward a radial direction outer side of the rotation shaft inner cylinder 42A2. A first roller 43A is provided at a radial direction outer side portion of an upper face of the guide disk 42D, and performs following rotation when the guide disk 42D is integrally rotated with the rotation shaft inner cylinder 42A2. Moreover, a second roller 43B is provided at a radial direction outer side portion of a lower face of the guide disk 42D, and performs following rotation when the guide disk 42D is integrally rotated with the rotation shaft inner cylinder 42A2. The second roller 43B is disposed at the lower side of the first roller 43A with the guide disk 42D interposed therebetween.

The first roller 43A and the second roller 43B are rotatably attached to a rod end 44Z, with a direction of each of the rotation axes of the first roller 43A and the second roller 43B set along the radial direction of the guide disk 42D. The rod end 44Z is formed with an inverted L-shape, and includes an upper wall 44Z1 disposed at an upper side of the guide disk 42D, and a sidewall 44Z2 disposed at a lateral side of the guide disk 42D. The first roller 43A and the second roller 43B are rotatably attached to the sidewall 44Z2 of the rod end 44Z. A lower end portion of a rod body 44A extending in the apparatus vertical direction is fixed to an upper face of the upper wall 44Z1 of the rod end 44Z. The rod body 44A and the rod end 44Z configure part of a servo cylinder 44Y.

An upper portion of the rod body 44A is disposed inside a cylinder 44S of the servo cylinder 44Y and is coupled thereto by a ball screw (not illustrated in the drawings). The rod body 44A extends in the apparatus vertical direction and is configured so as to move in the apparatus vertical direction relative to the cylinder 44S by rotation of the ball screw. Moreover, the servo cylinder 44Y includes an electrical servo motor 44M (illustrated as a block) employed to rotationally drive the ball screw. The stirring impeller 40 is thereby movable in the apparatus vertical direction by the servo cylinder 44Y being actuated by the electrical servo motor 44M.

Note that although the present exemplary embodiment has, for example, a single set of the servo cylinder 44Y, the first roller 43A, and the second roller 43B provided for the guide disk 42D, an alternative possible configuration has, for example, a pair of each of the servo cylinder 44Y, the first roller 43A, and the second roller 43B provided for the guide disk 42D, by being provided on each side of the rotation shaft inner cylinder 42A2. Moreover, although the servo cylinder 44Y is actually installed at a position away from the cross-sections illustrated in FIG. 1 to FIG. 4, the servo cylinder 44Y is illustrated by double-dot broken lines (phantom lines) in the cross-sections of FIG. 1 to FIG. 4 for convenience of explanation of the configuration. The first roller 43A and the second roller 43B are also omitted from illustration apart from in FIG. 5. Note that the rotation axis lines of the first roller 43A and the second roller 43B are illustrated in FIG. 2 by single-dot broken lines instead of illustrating the first roller 43A and the second roller 43B of FIG. 5.

As illustrated in FIG. 5, the stirring impeller 40 includes a frame body 40A formed in a frame shape, and a lattice shaped mesh portion 40B provided at an inside of the frame body 40A. However, a stirring impeller of another shape, such as one not equipped with a frame body 40A or a mesh portion 40B, may be applied instead of the stirring impeller 40 of the present exemplary embodiment. Note that in the perspective view illustrated in FIG. 5, the tank 20 is illustrated simplified with a bottomed cylindrical shape, and a lower portion of the stirring mechanism 12 is illustrated simplified with the tank 20 in a see-through state. A hole-opening closure section 46 capable of closing the pour hole 22 (illustrated by phantom lines (double-dot broken lines) in FIG. 5) is provided at a lower end portion of the stirring impeller 40. The hole-opening closure section 46 is part of a substantially rectangular plate shaped section (blocking plate for backflow prevention) including an overhang portion extending out toward a thickness direction outer side of the stirring impeller 40 from a lower end portion of the stirring impeller 40.

Moreover, a second movement mechanism 45 is provided in the present exemplary embodiment to move the stirring impeller 40 including the hole-opening closure section 46, namely to move the hole-opening closure section 46, between an open position 46X (see FIG. 2) where the pour hole 22 is open, and a closed position 46Y (see FIG. 4) where the pour hole 22 is closed. The second movement mechanism 45 is configured including the servo cylinder 44Y, the first roller 43A, the second roller 43B, the guide disk 42D, the rotation shaft inner cylinder 42A2, the rotation shaft outer cylinder 42A1, and portions of the stirring impeller 40 other than the hole-opening closure section 46. The electrical servo motor 44M of the servo cylinder 44Y configuring part of the second movement mechanism 45 is connected to an open-close controller 48, and driving of electrical servo motor 44M is controlled by the open-close controller 48.

Figure 8C:
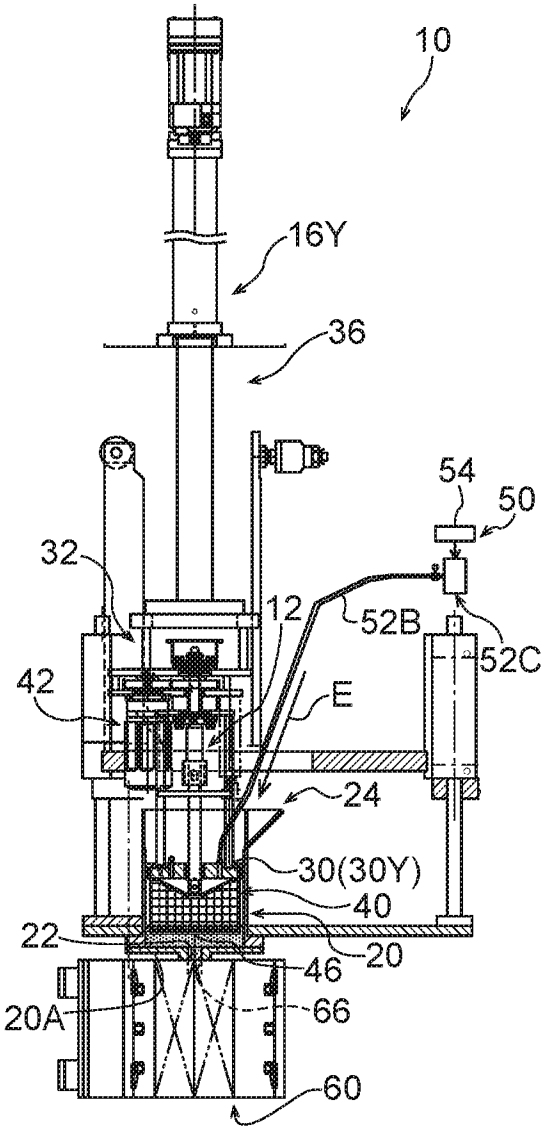
FIG. 8C is a schematic front view illustrating yet another operational state following the operational state illustrated in FIG. 7C that is different from the operational state illustrated in FIG. 8B.

Before the foam mixture inside the tank 20 illustrated in FIG. 8C is filled into the cavity of the mold 60 from the pour hole 22 via the fill hole 66, this is carried by the compressed air supply system 50 (see FIG. 2) supplying compressed air into the tank 20, the open-close controller 48 controls driving of the second movement mechanism 45, or more specifically driving of the electrical servo motor 44M of the servo cylinder 44Y, so as to move the hole-opening closure section 46 illustrated in FIG. 5 from the closed position 46Y (see FIG. 4) toward an upward side separated therefrom. After the foam mixture inside the tank 20 has been filled into the cavity of the mold 60 by the compressed air supply system 50 (see FIG. 2) supplying compressed air into the tank 20, the open-close controller 48 controls the second movement mechanism 45 so as to move the hole-opening closure section 46 illustrated in FIG. 4 to the closed position 46Y.

In the molding mechanism 14 illustrated in FIG. 1, the mold 60 forms the cavity using a fixed mold 62 and a movable mold 64. The movable mold 64 is movable in the apparatus left-right direction by a mover mechanism 14A. The mover mechanism 14A is provided on a machine bed 14B, and is configured including a cylinder 14A1 disposed with its axial direction along the apparatus left-right direction. Note that although not described in detail, as illustrated in FIG. 6, the orientation of a movable surface of the movable mold 64 can be changed in a state in which the movable mold 64 is disposed at a position separated from the fixed mold 62.

Moreover, as illustrated in FIG. 1, the fixed mold 62 is supported by a support mechanism 14C provided at the machine bed 14B, and is disposed at a lateral side (the apparatus left side in the present exemplary embodiment) of the movable mold 64. Moreover, the fill hole 66 mentioned above is formed so as to pass through an upper wall of the mold 60. Note that the fill hole 66 in the present exemplary embodiment is configured by a notch at an upper wall 62A of the fixed mold 62, and by a notch at an upper wall 64A of the movable mold 64.

A servo cylinder 16Y is supported from the machine upper frame 70. The servo cylinder 16Y is configured including a cylinder 16S and a rod 16A disposed with its axial direction along the apparatus vertical direction, and an electrical servo motor 16M (see FIG. 3) for driving. As illustrated in FIG. 2, a lower end portion of the rod 16A is connected to the lid member 30 through a coupling structure 32. The coupling structure 32 is configured including plural rods 32A fixed to, and extending upward from, an upper face of the lid member 30, and including an intermediate plate 32B that upper end portions of the rods 32A are fixed to. The intermediate plate 32B axially supports the rotation shaft 42A.

The lid member 30 is disposed so as to be slidable while being sealed against an inner face of the tank 20 (a hermetically sealed state), such that the lid member 30 is moved in a direction to approach the bottom wall 20A of the tank 20 or in the opposite direction thereto (in other words in the apparatus vertical directions) by actuation of the electrical servo motor 16M (see FIG. 3) of the servo cylinder 16Y. A lift mechanism 36 including the servo cylinder 16Y and the coupling structure 32 is configured so as to raise or lower the lid member 30 between a first position 30X and a second position 30Y (see FIG. 8C). The lid member 30 is at the opening section 20K side from a flow path lower end of the component material feeder 24 at the first position 30X, and the lid member 30 is at the bottom wall 20A side from the flow path lower end of the component material feeder 24 at the second position 30Y.

As illustrated in FIG. 3, the electrical servo motor 16M of the lift mechanism 36 is connected to a lift controller 38. The lift controller 38 controls the lift mechanism 36 so that at a timing that the component materials are fed from the component material feeder 24 into the tank 20, the lid member 30 is disposed at the first position 30X (the position illustrated in FIG. 2), and controls the lift mechanism 36 so that at a timing that the foam mixture inside the tank 20 is filled into the cavity of the mold 60, the lid member 30 is disposed at the second position 30Y.

As illustrated in FIG. 2, the plug mechanism 18, which serves as a pour-hole closure mechanism is provided at the lower side of the tank 20 and the upper side of the molding mechanism 14 (see FIG. 1). The plug mechanism 18 includes a plug 18A for opening and closing the pour hole 22 of the tank 20. The plug 18A projects to the upper side from a horizontally disposed plug plate 18B. The plug plate 18B is attached to an upper end portion of a piston rod 18R of an upward facing cylinder 18Y, so as to be moved vertically by actuation of the cylinder 18Y. The plug mechanism 18 is capable of closing the pour hole 22 using the plug 18A. Note that a support member 18D to support the cylinder 18Y is configured so as to be moveable in the apparatus left-right direction by a non-illustrated movement mechanism.

The compressed air supply system 50 includes a port 52A and a pressure gauge 52G in the lid member 30, and a compressed air supply device 52C is connected to the port 52A via a hose 52B, a flow rate gauge 52D, and a three-way valve 52E. The compressed air supply device 52C is capable of supplying compressed air into an internal space of the tank 20 via the flow rate gauge 52D, the three-way valve 52E, the hose 52B, and the port 52A. The pressure gauge 52G is capable of measuring the pressure of the internal space of the tank 20.

The compressed air supply system 50 includes an air supply controller 54 connected to each of the pressure gauge 52G, the flow rate gauge 52D, the three-way valve 52E, and the compressed air supply device 52C. Note that the connections between the pressure gauge 52G and the air supply controller 54 are omitted from illustration in the drawings. The air supply controller 54 controls actuation of each of the compressed air supply device 52C and the three-way valve 52E.

Operation and Advantageous Effects

Next, explanation follows regarding the operation and advantageous effects of the above exemplary embodiment by describing a casting mold making method to make a casting mold by filling a foam mixture into the cavity of the mold 60 (see FIG. 1) using the casting mold making apparatus 10, with reference to FIG. 7 to FIG. 9. Note that control processing in the casting mold making method described below is executed in the sequence of the description below by a control processing program stored in a storage section (not illustrated in the drawings) of the casting mold making apparatus 10 being executed according to operation by an operator at the operation section (not illustrated in the drawings) of the casting mold making apparatus 10.

Figure 7C:
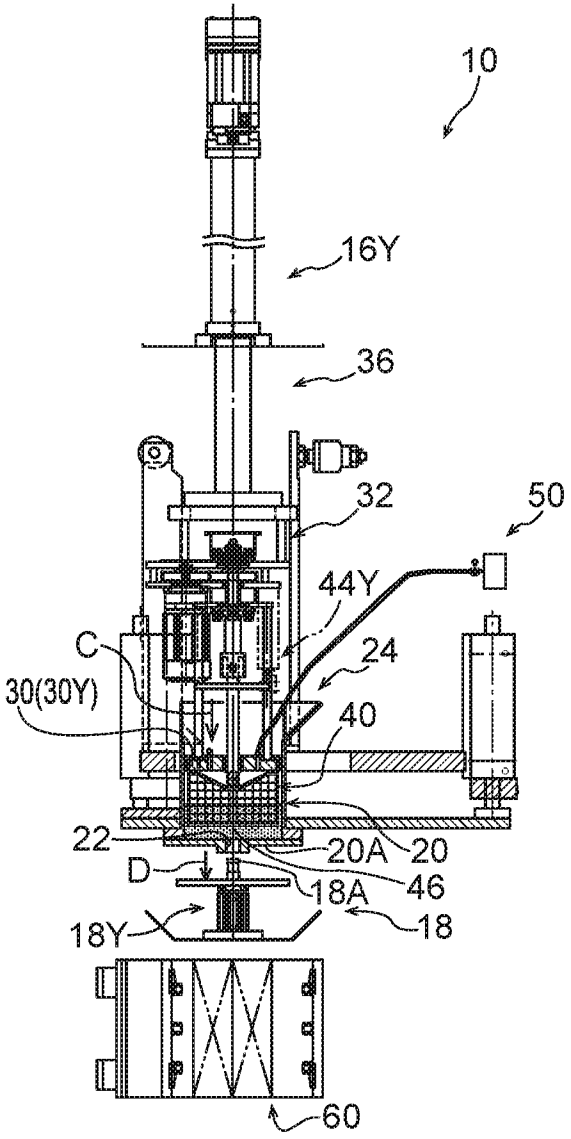
FIG. 7C is a schematic front view illustrating a third operational state of part of the casting mold making apparatus of FIG. 1 that is different from the second operational state.
Figure 7B:
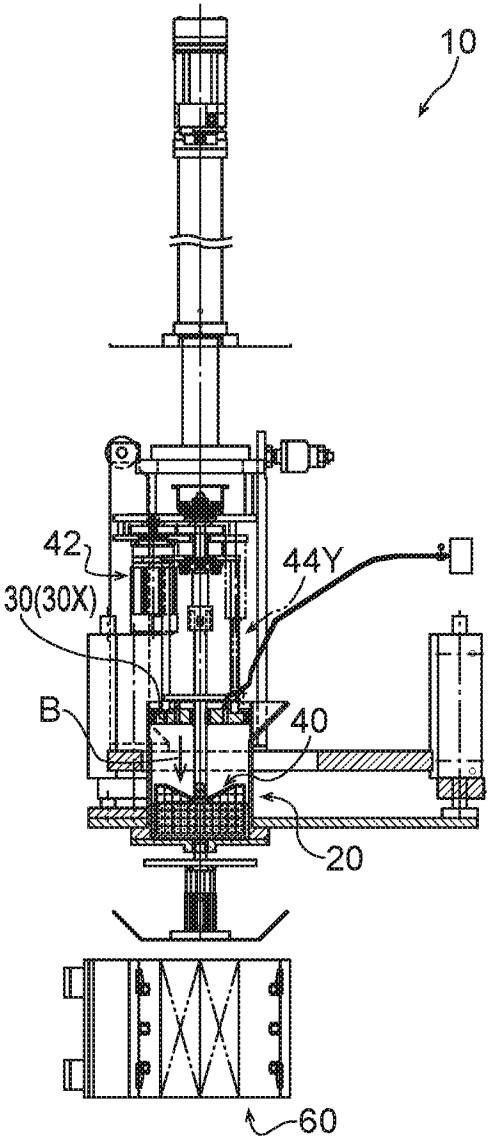
FIG. 7B is a schematic front view illustrating a second operational state of part of the casting mold making apparatus of FIG. 1 that is different from the first operational state.
Figure 7A:
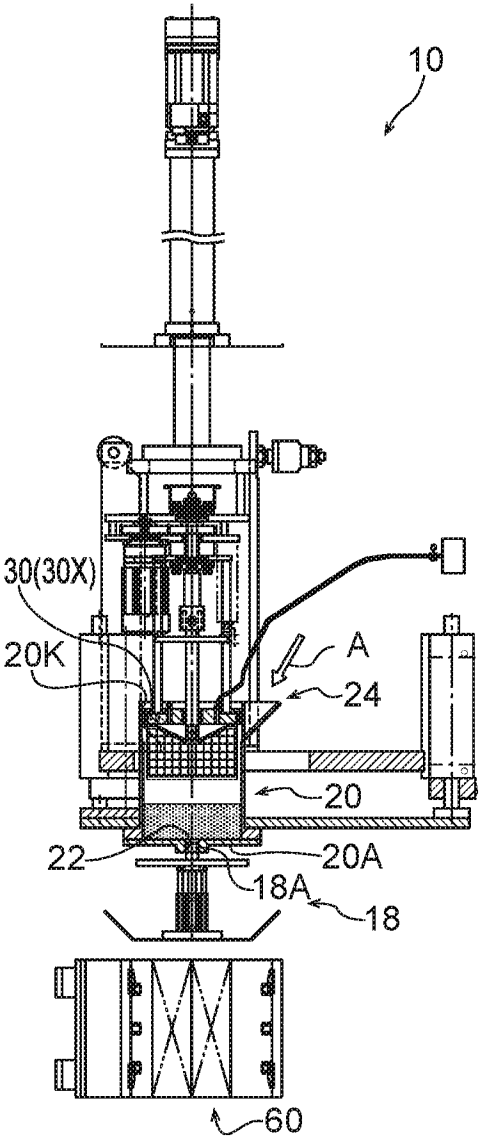
FIG. 7A are is a schematic front view illustrating a first operational state of part of the casting mold making apparatus of FIG. 1.

First, the pour hole 22 in the tank 20 illustrated in FIG. 7A is closed by the plug 18A of the plug mechanism 18, then with the opening section 20K side in a closed state by the lid member 30, the component materials (sand, water soluble binder, water, and additives) employed for making the foam mixture are fed (poured) (see arrow A) from the component material feeder 24 to inside the tank 20 using the component material feed device 28 (see FIG. 2).

Next, as illustrated in FIG. 7B, after the stirring impeller 40 has been lowered (see arrow B) by actuating the servo cylinder 44Y, the component materials inside the tank 20 are stirred with the stirring impeller 40 by actuating the stirring impeller actuation mechanism 42. This thereby makes the foam mixture. Note that the processes illustrated in FIG. 7A and FIG. 7B correspond to a first process of the present example.

Next, as illustrated in FIG. 7C, the stirring impeller 40 is moved up in the direction to separate from the bottom wall 20A of the tank 20 by actuating the servo cylinder 44Y. The lid member 30 is also lowered (see arrow C) by actuation of the servo cylinder 16Y (the lift mechanism 36). When this is performed, in order to make the pressure inside the tank 20 atmospheric pressure, the three-way valve 52E (see FIG. 2, a valve employed for release to the atmosphere) provided in the compressed air supply system 50 is switched over and exhausting performed. The lid member 30 is disposed at the second position 30Y so as to be positioned at the bottom wall 20A side from the flow path lower end of the component material feeder 24. Furthermore, the pour hole 22 in the bottom wall 20A is opened by actuating the cylinder 18Y of the plug mechanism 18 and lowering the plug 18A (see arrow D). The plug mechanism 18 equipped with the plug 18A is then moved to the apparatus right side by actuating a non-illustrated movement mechanism so as to adopt the state illustrated in FIG. 8A.

Figure 8B:
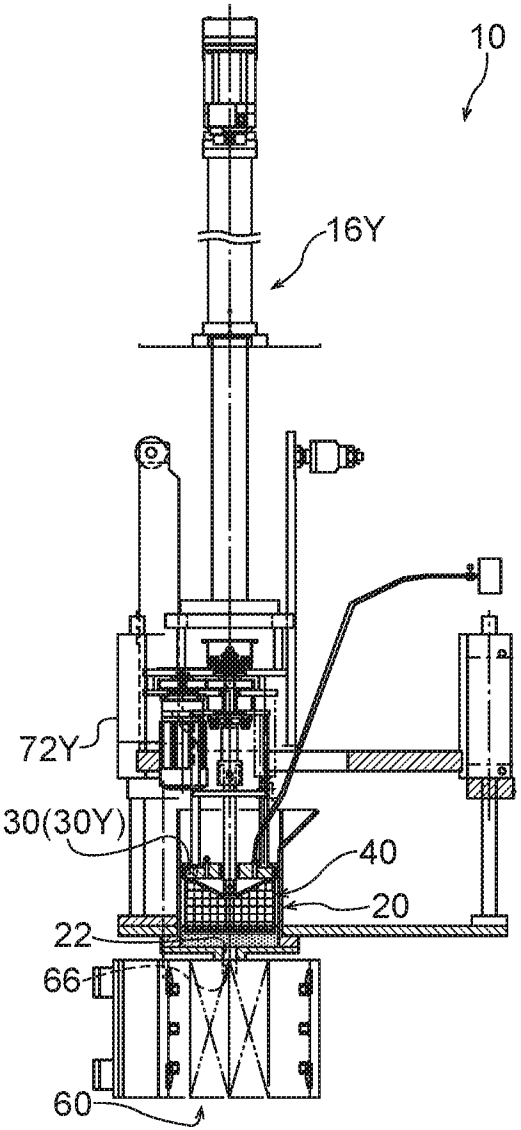
FIG. 8B is a schematic front view illustrating another operational state following the operational state illustrated in FIG. 7C that is different from the one operational state.
Figure 8A:
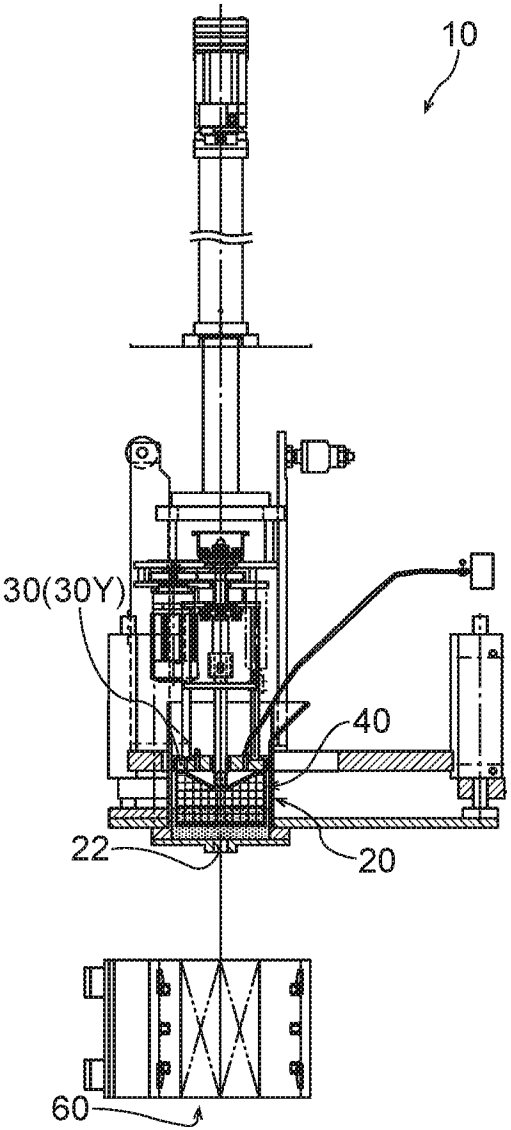
FIG. 8A is a schematic front view illustrating one operational state following that of the operational state illustrated in FIG. 7C.

Next, as illustrated in FIG. 8B, the tank 20 is lowered by actuating the cylinder 72Y, and the tank 20 is pressed strongly against the mold 60. The pour hole 22 of the tank 20 is thereby disposed adjacent to the fill hole 66 of the mold 60. Moreover, when this is performed, the lid member 30 and the stirring impeller 40 in the tank 20 are also lowered in synchronization by actuation of the servo cylinder 16Y.

Next, as illustrated in FIG. 8C, the stirring impeller 40 stirs the foam mixture inside the tank 20 (a mixture having thixotropic properties) by actuating the stirring impeller actuation mechanism 42 of the stirring mechanism 12, and while the viscosity of the foam mixture is lowered, compressed air is supplied into the tank 20 by the compressed air supply system 50 (see arrow E), and the foam mixture inside the tank 20 is filled into the cavity of the mold 60 from the pour hole 22 via the fill hole 66.

Due to the lid member 30 being disposed in the second position 30Y as described above, in the present exemplary embodiment the compressed air supplied from the compressed air supply system 50 into the tank 20 can be suppressed from leaking out from the component material feeder 24. Moreover, due to the compressed air being supplied into the tank 20 while the stirring impeller 40 is stirring the foam mixture inside the tank 20, the amount of compressed air can be reduced (and hence the energy employed to supply the compressed air decreased) in comparison to cases in which compressed air is supplied into the tank 20 in a state in which the foam mixture is not being stirred. Namely, by rotating the stirring impeller 40 while the foam mixture is being fed into the cavity of the mold 60 (during filling), the viscosity of the foam mixture (a non-Newtonian fluid) is lowered, and the fluidity thereof can be raised. This thereby enables the amount of compressed air when the foam mixture is being fed to be reduced and for the feedabilty of the foam mixture to be raised. Furthermore, stable feedabilty can be secured, as the compressed air levels indentations and projections on the foam mixture surface. Note that the processes illustrated in FIG. 7C to FIG. 8C correspond to a second process of the present example.

The actuation speed of the stirring impeller 40 during stirring in the process illustrated in FIG. 8C (the second process) is set to be a lower speed than the actuation speed of the stirring impeller 40 during stirring in the process illustrated in FIG. 7B (the first process). Thus in the present exemplary embodiment, the foam mixture can be stably filled into the cavity of the mold 60 while the behavior of the foam mixture inside the tank 20 illustrated in FIG. 8C is stabilized.

Moreover, when the foam mixture inside the tank 20 is being filled into the cavity of the mold 60 in the process illustrated in FIG. 8C (the second process), the pressure of the compressed air supplied into the tank 20 from the start of filling the foam mixture to immediately before filling completion is set to be lower than the pressure of the compressed air supplied into the tank 20 at completion of filling the foam mixture and directly after filling completion.

This enables the compressed air to be prevented or suppressed from breaking through the foam mixture during foam mixture filling, and enables the foam mixture to be suppressed from flowing back from the cavity of the mold 60 when it undergoes thermal expansion after the end of foam mixture filling.

Furthermore, in the present exemplary embodiment, prior to the foam mixture inside the tank 20 being filled into the cavity of the mold 60, the stirring impeller 40 is moved in the direction to separate from the bottom wall 20A (FIG. 8B and FIG. 8C), enabling the prevention or suppression of a situation in which, when the foam mixture is being filled into the cavity of the mold 60, the foam mixture is impeded from passing through the pour hole 22 by the stirring impeller 40 including the hole-opening closure section 46.

Figure 9C:
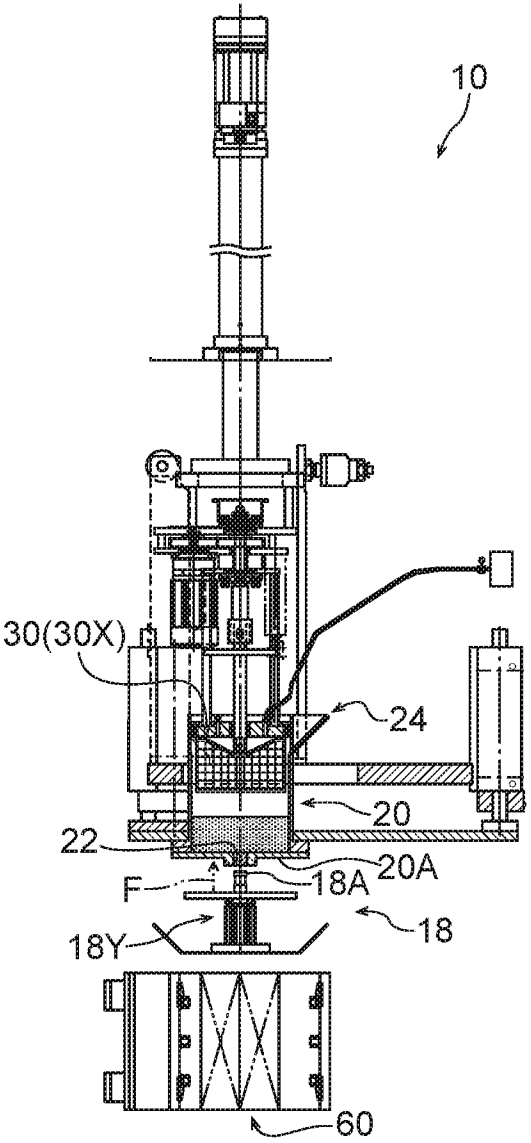
FIG. 9C is a schematic front view illustrating yet another operational state following the operational state illustrated in FIG. 8C that is different from the operational state illustrated in FIG. 9B.
Figure 9B:
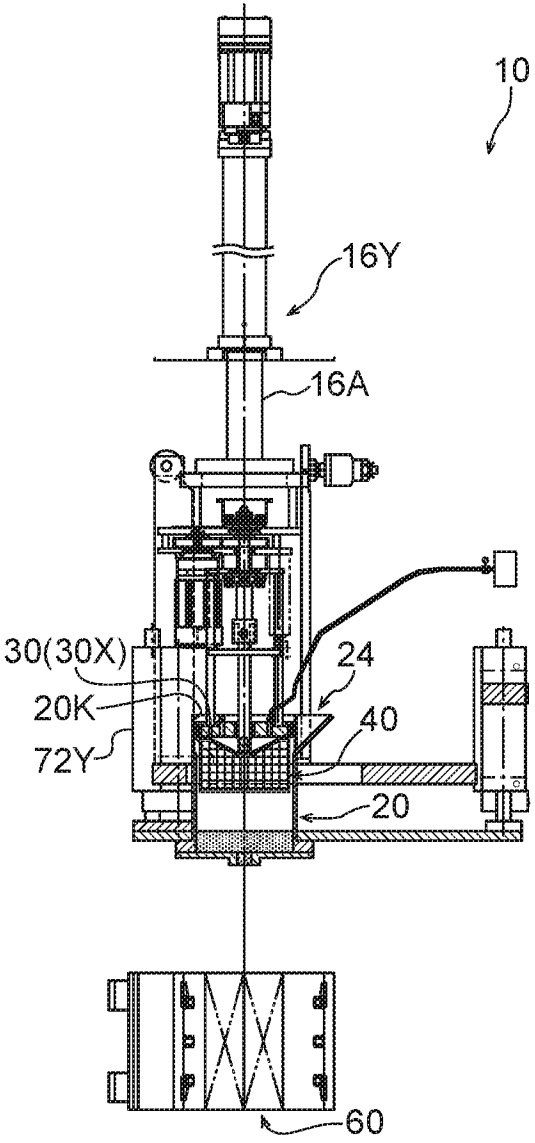
FIG. 9B is a schematic front view illustrating another operational state following the operational state illustrated in FIG. 8C that is different from the operational state illustrated in FIG. 9A.
Figure 9A:
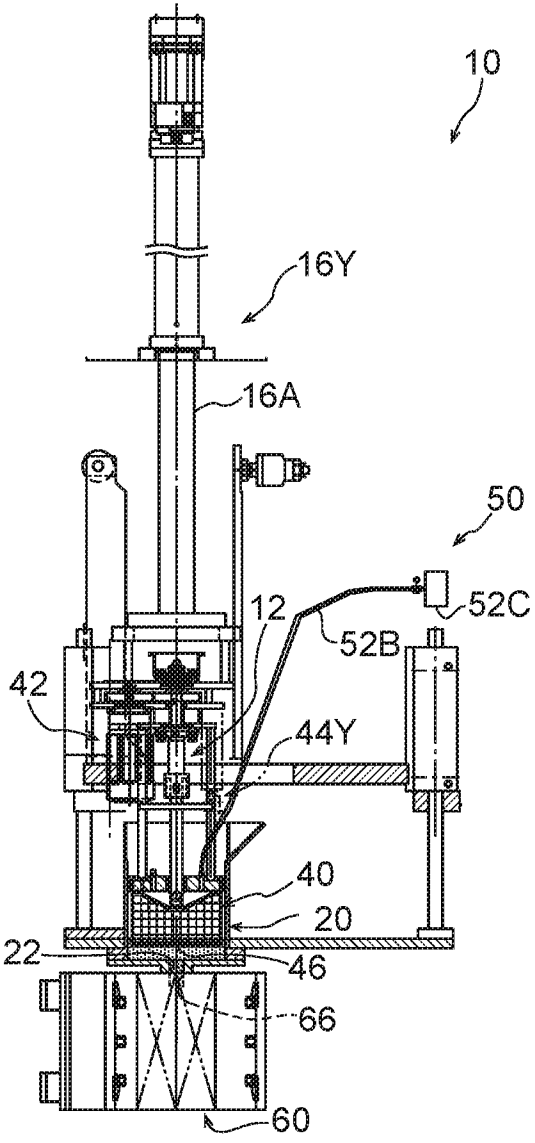
FIG. 9A is a schematic front view illustrating one operational state following the operational state illustrated in FIG. 8C.

Then as illustrated in FIG. 9A, actuation of the stirring impeller actuation mechanism 42 is stopped and the rotation of the stirring impeller 40 stops. Moreover, after the pressure from the compressed air being supplied from the compressed air supply system 50 has reduced, the compression from the compressed air is released.

Note that in the present exemplary embodiment, the servo cylinder 44Y is actuated after the foam mixture inside the tank 20 has been filled into the cavity of the mold 60 from the pour hole 22 via the fill hole 66 (in the second process). The hole-opening closure section 46 configuring part of the stirring impeller 40 is thereby moved to the closed position 46Y, as illustrated in FIG. 4, and the opening of the pour hole 22 is closed by the hole-opening closure section 46 for a predetermined closed time. This also enables the backflow of the foam mixture into the tank 20 from the cavity of the mold 60 to be prevented.

Next, as illustrated in FIG. 9B, the tank 20 is raised by actuation of the cylinder 72Y, and the tank 20 is separated from the mold 60. Moreover, when this is performed, the lid member 30 and the stirring impeller 40 in the tank 20 are also raised by actuation of the servo cylinder 16Y, and the lid member 30 is disposed at the first position 30X positioned at the opening section 20K side from the flow path lower end of the component material feeder 24.

Next, as illustrated in FIG. 9C, the plug mechanism 18 is moved from the right side of the apparatus to directly below the tank 20 by actuation of a non-illustrated movement mechanism. Moreover, the pour hole 22 of the tank 20 is closed, as illustrated in FIG. 7A, by the cylinder 18Y of the plug mechanism 18 being actuated and the plug 18A being raised (see arrow F). Namely, after being in the operational state of FIG. 9C, the casting mold making apparatus 10 returns to the operational state of FIG. 7A, and from then on the cycle described above is repeated. Note that, with regard to the casting mold making apparatus 10 returned to the operational state of FIG. 7A, due to the lid member 30 being disposed in the first position 30X in the FIG. 7A state, the component material feeder 24 can be employed to feed the component materials into the tank 20.

This means that when making the foam mixture in the tank 20 illustrated in FIG. 1, there is no need to retract a portion of the mechanism to fill the foam mixture into the mold 60 from inside the tank 20 to outside the tank 20. Moreover, there is also no need for the stirring impeller 40 to be retracted from inside the tank 20 to outside the tank 20 when the foam mixture is being filled from the tank 20 into the mold 60. The foam mixture accordingly does not splash outside the tank 20. Namely, in order to fill the foam mixture into the mold 60, the compressed air is supplied into the tank 20 by the compressed air supply system 50, and the foam mixture inside the tank 20 is filled into the cavity of the mold 60 from the pour hole 22 via the fill hole 66. The foam mixture inside the tank 20 is stirred by the stirring impeller 40 of the stirring mechanism 12, raising the efficiency with which the cavity of the mold 60 is filled due to the viscosity of the foam mixture being lowered thereby.

As described above, the present exemplary embodiment enables splashing of the foam mixture to be prevented or effectively suppressed during mixing and during filling.

Moreover, in the present exemplary embodiment, due to there being no need for a portion of the mechanism for filling the foam mixture into the mold 60 or the stirring impeller 40 to be taken out of and replace in the tank 20, the time from making the foam mixture until filling the mold 60 can be shortened, thereby enabling the molding cycle to also be shortened. Moreover, in the present exemplary embodiment, there are only a few moving parts in the casting mold making apparatus 10, and filling of the foam mixture into the mold 60 is achieved by pressurizing with compressed air. This accordingly enables the apparatus itself to be simplified and made more compact.

Supplementary Description of the Exemplary Embodiment

Although in the exemplary embodiment described above, the feed direction of the foam mixture from the tank 20 into the cavity of the mold 60 is a vertical direction from the apparatus upper side to the apparatus lower side, the feed direction of the foam mixture from a tank into the cavity of a mold may be set to a lateral direction or a downward inclined direction.

Although in the exemplary embodiment described above, the component material feed into the tank 20 is from the upper side of the component material feeder 24, in a modified example of the exemplary embodiment described above, a configuration may be adopted in which, for example, a component material feed port is formed so as to pass through a lid member (30) and a closure member is provided to open or close the component material feed port, so as to feed the component material inside the tank (20) through this component material feed port.

As a modified example of the exemplary embodiment described above, in addition to rotating a stirring impeller (40) in order to improve the filling properties of the foam mixture into the mold and to secure a stable feed performance of the foam mixture, a function may also be provided to vibrate the stirring impeller (40) or to vibrate the tank (20).

Although in the exemplary embodiment described above, the hole-opening closure section 46 and the open-close controller 48 are provided as illustrated in FIG. 5, and such a configuration is preferable from the perspective of preventing backflow as described above, a configuration may be adopted in which neither the hole-opening closure section 46 nor the open-close controller 48 is provided.

Although in the exemplary embodiment described above there is a single pour hole 22 formed so as to pass through the bottom wall 20A of the tank 20, as a modified example of the exemplary embodiment described above, a configuration may be adopted in which plural fill holes are formed so as to pass through a bottom wall (20A) of a tank (20), and plural plugs corresponding to these fill holes are provided in the plug mechanism (the pour-hole closure mechanism) in order to open and close the fill holes. In such a modified example, the plural fill holes may, for example, include a fill hole provided at a position similar to that of the pour hole 22 illustrated in FIG. 5 and be arranged so as to form a row in a plan view of the apparatus. In such cases, a stirring impeller (40) may be set so as to stop in a state extending in the same direction as the row direction of the plural fill holes in apparatus plan view (in other words, may be set so that the stirring impeller (40) is superimposed on the plural fill holes in apparatus plan view when the stirring impeller (40) has stopped).

Moreover, in the exemplary embodiment described above, the actuation speed of the stirring impeller 40 during stirring in the second process is set so as to be a lower speed than the actuation speed of the stirring impeller 40 during stirring in the first process, and such a configuration is preferable. However, for example, a setting therefor other than the setting of the exemplary embodiment may be adopted, such as by setting so as to be same as the actuation speed of an stirring impeller (40) during stirring in the first process, or the like.

In a modified example of the exemplary embodiment described above, the position of the lid member 30 while stirring the component materials inside the tank 20 illustrated in FIG. 7B by the stirring impeller 40 may be the second position 30Y (see FIG. 7C) and not the first position 30X illustrated in FIG. 7B. More specifically, a timing at which the position of the lid member 30 is displaced from the first position 30X to the second position 30Y (see FIG. 7C) may be set to any timing that is after the component materials have been fed out from the component material feeder 24 to inside the tank 20 illustrated in FIG. 7A and before the foam mixture inside the tank 20 is filled into the cavity of the mold 60 illustrated in FIG. 8C. Moreover, the timing at which the position of the lid member 30 is displaced from the second position 30Y to the first position 30X (see FIG. 7A) may be set at any timing after the foam mixture inside the tank 20 has been filled into the cavity of the mold 60 illustrated in FIG. 8C and before the component materials are fed from the component material feeder 24 into the tank 20 illustrated in FIG. 7A.

Moreover, although in the exemplary embodiment described above, as illustrated in FIG. 7C, the stirring impeller 40 is moved in a direction to separate from the bottom wall 20A of the tank 20 by actuation of the servo cylinder 44Y before the foam mixture is filled into the cavity of the mold 60, and such a configuration is preferable, a configuration may be adopted without such a movement set.

Although the setting of the pressure of compressed air when the foam mixture inside the tank 20 is filled into the cavity of the mold 60 illustrated in FIG. 8C in the second process is preferably as set in the exemplary embodiment described above, a setting different to the setting of the exemplary embodiment described above may be adopted.

The compressed air supplied by a compressed air supply system (50) into a tank (20) is not limited to being atmospheric air, and an inert gas, such as nitrogen gas or argon gas, or carbon dioxide, may be supplied from a gas canister.

Note that combinations of the exemplary embodiments described above and the modified examples described above may be implemented.

Although the present invention has been described above by way of examples, the present invention is not limited to the above, and obviously various modifications may be implemented within a range not departing from the scope thereof.

The entire content of the disclosure of Japanese Patent Application No. 2017-100267 is incorporated by reference in the present specification.

All publications, patent applications and technical standards mentioned in the present specification are incorporated by reference in the present specification to the same extent as if each individual publication, patent application, or technical standard was specifically and individually indicated to be incorporated by reference.

The invention claimed is:

1. An apparatus for making a casting mold, the apparatus comprising:

a tank into which component materials for making a foam mixture are fed, the tank being formed with a pour hole that passes through a bottom wall of the tank and an opening section that opens toward an opposite side from a bottom wall side;

a lid member that opens and closes an opening section side of the tank;

a plug that opens and closes the pour hole of the tank;

a stirring mechanism that stirs the component materials inside the tank with a stirring impeller so as to make a foam mixture in a state in which the opening section side is closed by the lid member;

a mold formed with a fill hole that passes into the mold, the fill hole being adjacent to the pour hole of the tank;

a compressed air supply system that supplies compressed air into the tank in a case in which the foam mixture inside the tank is filled into a cavity of the mold from the pour hole via the fill hole, with the pour hole in an opened state; and an actuator that raises and lowers the lid member between a first position and a second position, wherein the lid member is positioned closer to the bottom wall side in the second position than in the first position, wherein the lid member is positioned at the second position in the case in which the foam mixture is filled into the cavity of the mold from the pour hole via the fill hole, wherein in each of the first and second positions of the lid member, the actuator and the tank are aligned with one another in a vertical direction until filling of the foam mixture into the cavity of the mold is completed;

wherein a seal member is provided around an outer peripheral portion of the lid member, and when the lid member is in the second position, the lid member is positioned inside the tank.

2. The apparatus of claim 1, further comprising:

a hole-opening closure section that is provided at the stirring impeller and that is capable of closing the pour hole;

a second actuator that moves the hole-opening closure section between an open position at which the pour hole is open and a closed position at which the pour hole is closed; and an open-close controller that controls such that the second actuator moves the hole-opening closure section to the closed position after the compressed air supply system has supplied compressed air into the tank and the foam mixture inside the tank has been filled into the cavity of the mold from the pour hole via the fill hole.

3. The apparatus of claim 1, further comprising:

a component material feeder that introduces component materials into the tank, the component material feeder being formed at a sidewall at the opening section side of the tank; and a lift controller that controls the actuator such that the lid member is disposed at the first position in a case in which the component materials are fed into the tank from the component material feeder, and such that the lid member is disposed at the second position in the case in which the foam mixture inside the tank is filled into the cavity of the mold from the pour hole via the fill hole, wherein:

the actuator raises the lid member toward the first position, the lid member is positioned closer to the opening section side from a flow path lower end of the component material feeder in the first position than in the second position, the actuator lowers the lid member toward the second position, and the lid member is positioned closer to the bottom side wall from the flow path lower end of the component material feeder in the second position than in the first position.

4. A method for making a casting mold by filling a foam mixture into a cavity of a mold, the method comprising:

a first process of:

feeding component materials for making a foam mixture into a tank, the tank being formed with a pour hole that passes through a bottom wall of the tank and an opening section that opens toward an opposite side from a bottom wall side, and stirring the component materials inside the tank with a stirring impeller so as to make a foam mixture in a state in which an opening section side of the tank is closed by a lid member and the pour hole is closed by a plug; and a second process, performed after the first process, of:

actuating the plug to open the pour hole, pressing the tank against the mold such that the pour hole is disposed adjacent to a fill hole that is formed so as to pass into the mold, and supplying compressed air into the tank while stirring the foam mixture inside the tank with the stirring impeller so as to fill the foam mixture inside the tank into a cavity of the mold from the pour hole via the fill hole, wherein:

the lid member is positioned at a first position with respect to the tank in the first process, the lid member is positioned at a second position with respect to the tank in the second process, the lid member is positioned closer to the bottom wall side in the second position than in the first position, in each of the first and second positions of the lid member with respect to the tank, the tank and an actuator that raises and lowers the lid member between the first and second positions are aligned with one another in a vertical direction until filling of the foam mixture into the cavity of the mold is completed, wherein a seal member is provided around an outer peripheral portion of the lid member, and when the lid member is in the second position, the lid member is positioned inside the tank.

5. The method of claim 4, wherein an actuation speed of the stirring impeller during stirring in the second process is a lower speed than an actuation speed of the stirring impeller during stirring in the first process.

6. The method of claim 4, wherein, after stirring the component materials inside the tank with the stirring impeller and making the foam mixture in the first process, the stirring impeller is moved to separate from the bottom wall prior to filling the foam mixture inside the tank into the cavity of the mold from the pour hole via the fill hole in the second process.

7. The method of claim 4, wherein, in a case in which the foam mixture inside the tank is filled into the cavity of the mold from the pour hole via the fill hole in the second process, a pressure of compressed air supplied into the tank within a period from starting filling the foam mixture to immediately before filling completion is lower than a pressure of compressed air supplied into the tank at completion of filling the foam mixture and directly after filling completion.

8. The method of claim 4, wherein, after the foam mixture inside the tank has been filled into the cavity of the mold from the pour hole via the fill hole in the second process, the stirring impeller is moved to a position at which a portion of the stirring impeller closes the pour hole.

* * * * *